US006111185A

United States Patent [19]

Lace

[11] Patent Number: 6,111,185

[45] Date of Patent: Aug. 29, 2000

[54] SENSOR ASSEMBLY FOR STRINGED MUSICAL INSTRUMENTS

[75] Inventor: Jeffrey J. Lace, Huntington Beach, Calif.

[73] Assignee: Actodyne General, Inc., Huntington Beach, Calif.

[21] Appl. No.: 09/231,201

[22] Filed: Jan. 14, 1999

Related U.S. Application Data

[60] Provisional application No. 60/072,917, Jan. 28, 1998.

[51] Int. Cl.[7] ..... G10H 3/18

[52] U.S. Cl. ..... 84/726; 84/728

[58] Field of Search ..... 84/726–728

[56] References Cited

U.S. PATENT DOCUMENTS

| | | | |
|---|---|---|---|
| 3,902,394 | 9/1975 | Stich | 84/728 |
| 3,992,972 | 11/1976 | Rickard . | |
| 4,010,334 | 3/1977 | Demeter . | |
| 4,050,341 | 9/1977 | Underwood . | |
| 4,096,780 | 6/1978 | Dawson . | |
| 4,145,944 | 3/1979 | Helpinstill, II . | |
| 4,184,399 | 1/1980 | Zuniga . | |
| 4,188,849 | 2/1980 | Rickard . | |
| 4,261,240 | 4/1981 | Aaroe . | |
| 4,378,722 | 4/1983 | Isakson . | |
| 4,499,809 | 2/1985 | Clevinger . | |
| 4,524,667 | 6/1985 | Duncan | 84/728 |
| 4,545,278 | 10/1985 | Gagon et al. . | |
| 4,581,974 | 4/1986 | Fender . | |
| 4,581,975 | 4/1986 | Fender . | |
| 4,809,578 | 3/1989 | Lace, Jr. . | |
| 4,869,144 | 9/1989 | Lieber . | |
| 4,872,386 | 10/1989 | Betticare . | |
| 4,885,970 | 12/1989 | Fender . | |
| 4,911,054 | 3/1990 | McClish . | |
| 5,027,691 | 7/1991 | Kennedy . | |
| 5,111,728 | 5/1992 | Blucher et al. . | |
| 5,168,117 | 12/1992 | Anderson . | |
| 5,189,241 | 2/1993 | Nakamura . | |
| 5,200,569 | 4/1993 | Moore . | |
| 5,252,777 | 10/1993 | Allen . | |
| 5,290,968 | 3/1994 | Mirigliano et al. . | |
| 5,292,998 | 3/1994 | Knapp . | |
| 5,292,999 | 3/1994 | Tumura . | |
| 5,311,806 | 5/1994 | Riboloff . | |
| 5,376,754 | 12/1994 | Stich . | |
| 5,389,731 | 2/1995 | Lace . | |
| 5,391,831 | 2/1995 | Lace . | |
| 5,391,832 | 2/1995 | Lace . | |
| 5,399,802 | 3/1995 | Blucher . | |
| 5,401,900 | 3/1995 | Lace . | |
| 5,408,043 | 4/1995 | Lace . | |
| 5,422,432 | 6/1995 | Lace . | |
| 5,430,246 | 7/1995 | Lace, Sr. et al. . | |
| 5,438,158 | 8/1995 | Riboloff . | |
| 5,464,948 | 11/1995 | Lace . | |
| 5,530,199 | 6/1996 | Blucher | 84/728 |

*Primary Examiner*—Stanley J. Witkowski
*Attorney, Agent, or Firm*—Bliss McGlynn, P.C.

[57] ABSTRACT

A sensor assembly for a stringed musical instrument having a plurality of movable strings includes a bobbin extending longitudinally, at least one magnet disposed within the bobbin for producing a magnetic polarity, and a coil extending longitudinally on each side of the bobbin for damping hum in the sensor assembly due to stray magnetic fields.

19 Claims, 2 Drawing Sheets

SENSOR ASSEMBLY FOR STRINGED MUSICAL INSTRUMENTS

CROSS-REFERENCE TO RELATED APPLICATION(S)

The present invention claims the priority date of co-pending U.S. Patent Application Serial No. 60/072,917, filed Jan. 28, 1998.

BACKGROUND OF THE INVENTION

1. Field of the Invention

The present invention relates generally to musical instruments and, more particularly, to a sensor assembly for use with stringed musical instruments.

2. Description of the Related Art

Generally, stringed musical instruments such as electric guitars have electromagnetic sensors or pick-ups for sensing mechanical vibrations of the strings and converting such into electrical signals. The electrical signals from the electromagnetic sensors are amplified and modified and, ultimately, reconverted into acoustical energy to produce music and the like.

An example of such an electromagnetic sensor is disclosed in U.S. Pat. No. 4,809,578, issued Mar. 7, 1989, entitled "Magnetic Field Shaping In An Acoustic Pick-up Assembly". This patented sensor assembly includes an elongated ferromagnetic case lined on the interior thereof with planar permanent magnet pieces to present the same magnetic polarity into the interior thereof. The patented sensor assembly also includes cores disposed in the interior of the case and having a plurality of coplanar, spaced, finger-like projections directed at the walls of the case. The walls and projections are permanently magnetized to a common magnetic polarity which will concentrate by magnetic repulsion flux into gaps between the projections. The patented sensor assembly further includes a coil wound around the cores and the flux changes of these concentrated flux fields due to string motion induce a voltage in the coil. The coil has terminals connected to a socket in the stringed musical instrument for connection to an amplifier and speaker system.

Although the above patented sensor assembly has worked well, it is typically situated among a mass of electronic equipment. As a result, the sensor assembly may respond to stray magnetic fields and attenuate extraneous noise or hum which is undesired.

Moreover, musicians which play stringed musical instruments are desirous of having sensors or pick-ups which incorporate greater sensitivity to the full range of acoustic energy generated by the movement of such strings. However, such greater sensitivity often requires a balancing of the overall sensitivity of the sensor or pick-up and the attenuation of extraneous noise or hum. Thus, there is a need in the art to provide a sensor which has greater sensitivity and substantially eliminates extraneous noise or hum.

SUMMARY OF THE INVENTION

It is, therefore, one object of the present invention to provide a sensor assembly for a stringed musical instrument.

It is another object of the present invention to provide a sensor assembly having a dual coil arrangement.

It is yet another object of the present invention to provide a sensor assembly which has a greater sensitivity than conventional humbucking pick-ups.

It is still another object of the present invention to provide a "hum" canceling sensor assembly.

It is a further object of the present invention to provide a sensor assembly with greater string to string definition and sensitivity.

It is yet a further object of the present invention to provide a dual coil sensor assembly which is less expensive to manufacture and assembly.

To achieve the foregoing objects, the present invention is a sensor assembly for a stringed musical instrument having a plurality of movable strings. The sensor assembly includes a bobbin extending longitudinally. The sensor assembly also includes at least one magnet disposed within the bobbin for producing a magnetic polarity. The sensor assembly further includes a coil extending longitudinally on each side of the bobbin for damping hum in the sensor assembly due to stray magnetic fields.

One advantage of the present invention is that a dual coil sensor assembly is provided for a stringed musical instrument. Another advantage of the present invention is that the sensor assembly has a two coil arrangement. Yet another advantage of the present invention is that the sensor assembly provides greater sensitivity than conventional humbucking pick-ups. A further advantage of the present invention is that the sensor assembly substantially eliminates extraneous noise. Yet a further advantage of the present invention is that the sensor assembly produces a damping effect by an arrangement of two coils such that the hum in one of the coils cancels out that in the other. A still further advantage of the present invention is that a dual coil sensor assembly is provided which is less expensive to manufacture.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
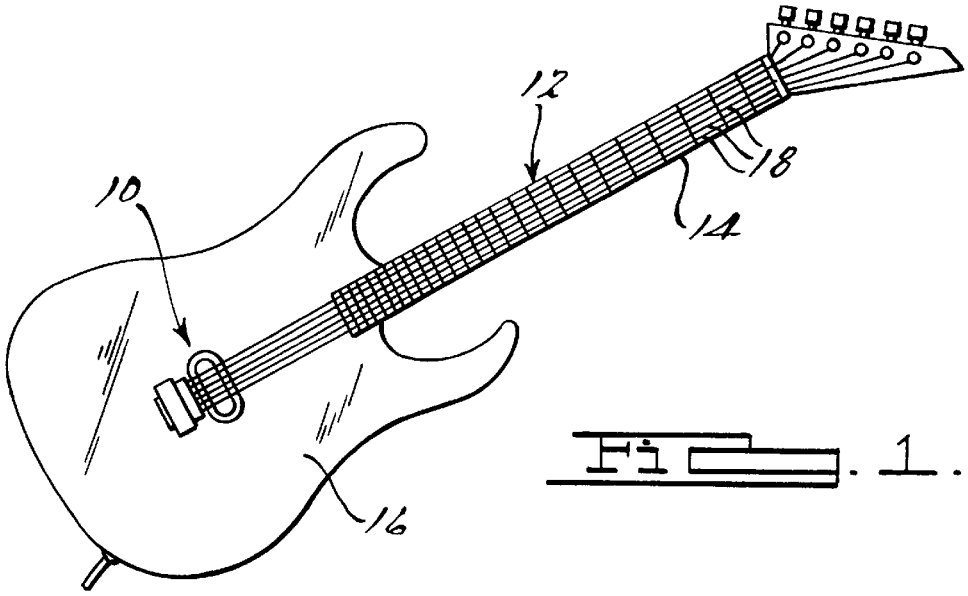
FIG. 1 is a perspective view of a sensor assembly, according to the present invention, illustrated in operational relationship to a stringed musical instrument.
Figure 2:
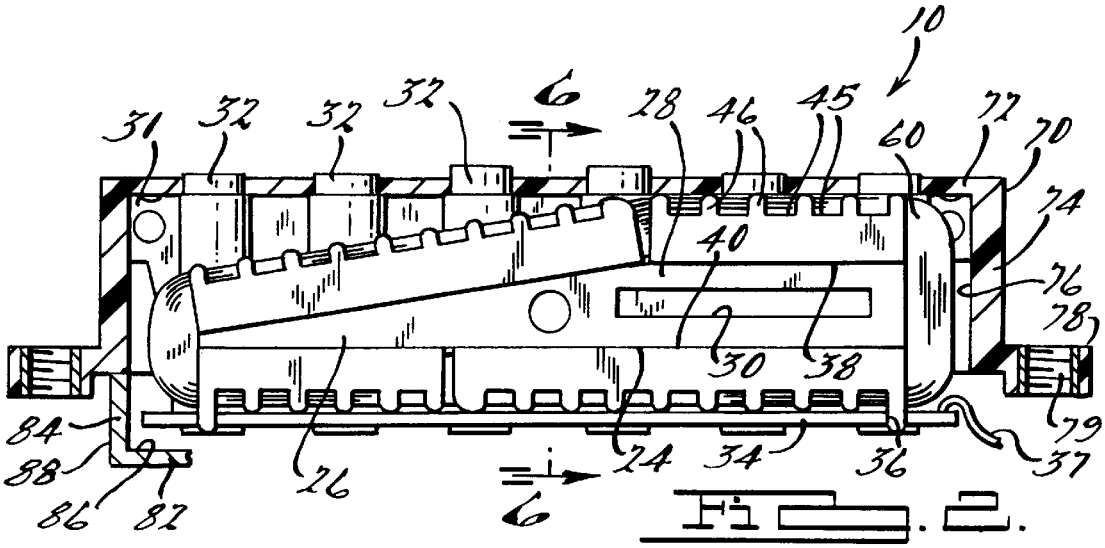
FIG. 2 is a fragmentary elevational view of the sensor assembly of FIG. 1.
Figure 3:
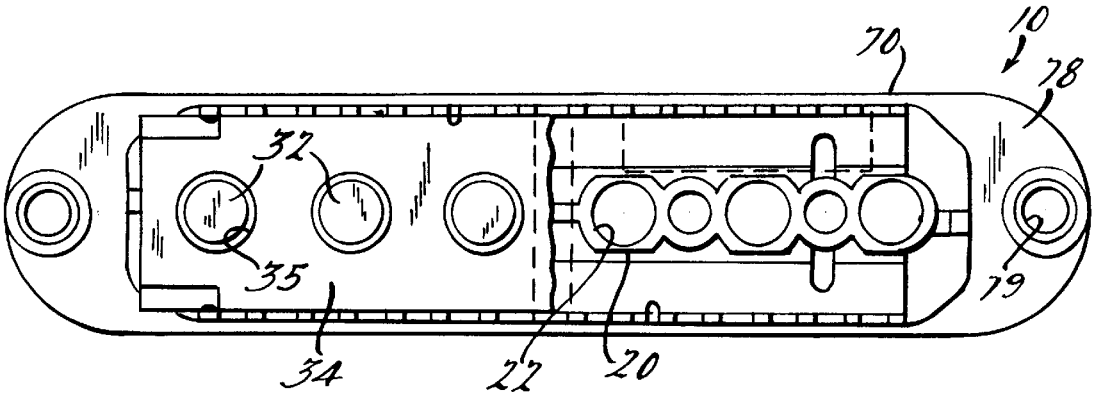
FIG. 3 is a fragmentary bottom view of the sensor assembly of FIG. 1.
Figure 4:
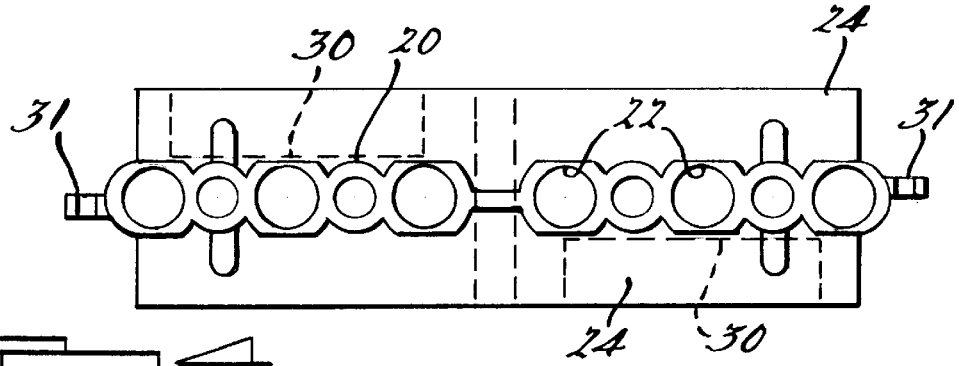
FIG. 4 is a top view of the sensor assembly of FIG. 1 with the cover removed.
Figure 5:
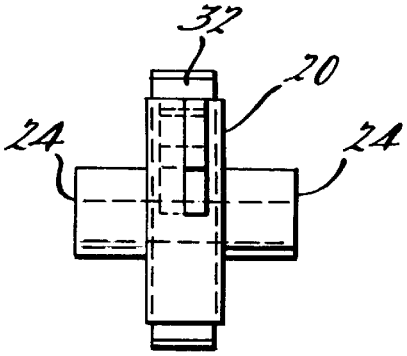
FIG. 5 is an end view of the sensor assembly of FIG. 1 with the cover removed.
Figure 6:
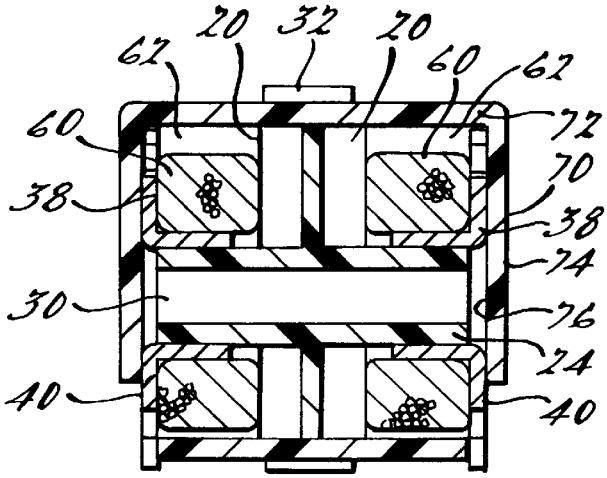
FIG. 6 is a sectional view taken along line 6—6 of FIG. 2.
Figure 7:
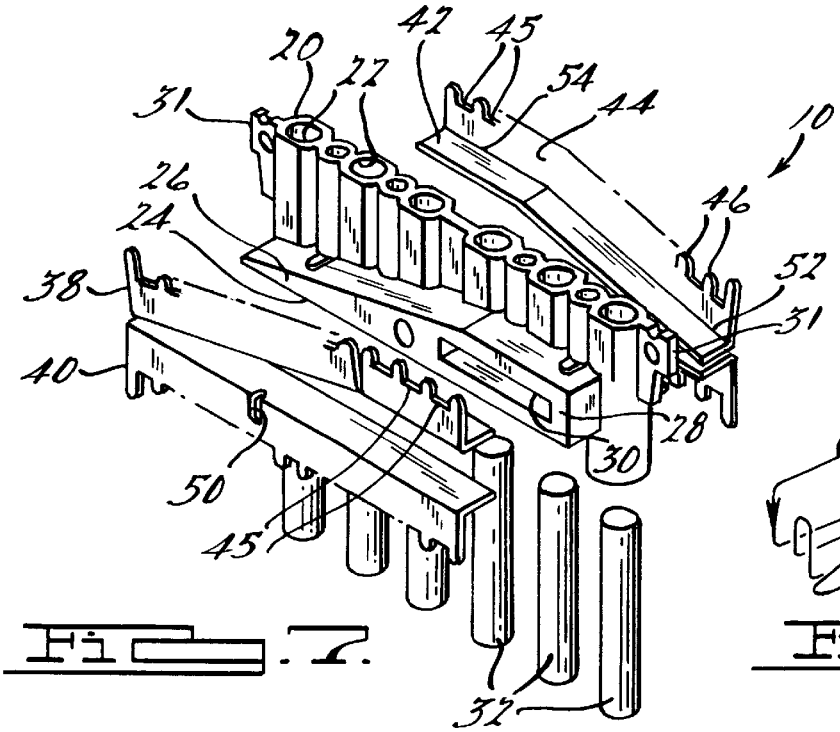
FIG. 7 is an exploded view of the sensor assembly of FIG. 1.

Referring to the drawings and in particular to FIG. 1, a sensor assembly 10, according to the present invention, is illustrated in operational relationship with a stringed musical instrument such as a guitar, generally indicated at 12. The guitar 12 is of the electric type and has a neck portion 14, a body portion 16, and a plurality of strings 18 extending along the neck and body portions 14 and 16. The sensor assembly 10 is disposed beneath the strings 18 and mounted to the body portion 16 in a manner to be described.

Referring to FIGS. 2 through 7, the sensor assembly 10 includes a bobbin 20 extending longitudinally and generally rectangular in shape. The bobbin 20 is orientated generally vertically and has at least one, preferably a plurality of apertures 22 extending therethrough and spaced longitudinally from one another for a function to be described. The bobbin 20 also has a flux diverter 24 extending laterally and longitudinally from each side thereof. The flux diverter 24 has a generally triangular portion 26 with a point at a lower end of one longitudinal end of the bobbin 20 and its hypotenuse extending upwardly to a midpoint vertically and two thirds longitudinally along the bobbin 20. The flux diverter 24 has a generally rectangular portion 28 extending longitudinally from the end of the triangular portion 26 to the longitudinal end of the bobbin 20. The rectangular portion 28 has a slot 30 extending laterally into the flux diverter 24. The bobbin 20 has a tab 31, extending longitudinally from an upper end at each longitudinal end thereof for a function to be described. The bobbin 20 is made as one-piece from a plastic material such as nylon. It should be appreciated that the flux diverter 24 on each side of the bobbin 20 has the point of the triangular portion 26 extending in opposite directions.

The sensor assembly 10 also includes at least one, preferably a plurality of magnets 32 disposed in the bobbin 20 and mounted therein by suitable means such as a friction fit or an adhesive bonding agent. The magnets 32 are made of a Alnico V permanent magnet material. Each magnet 32 extends axially and is generally cylindrical in shape. The magnets 32 are disposed in the apertures 22 of the bobbin 20. The magnets 32 may vary in axial length such that the magnets 32 at the longitudinal end have a height near a height of the bobbin 20 and the magnets 32 near the middle of the bobbin 20 have a height greater than the height of the bobbin 20.

When the magnets 32 are disposed in the bobbin 20, the magnets 32 present a magnetic polarity facing the strings 18. Each magnet 32 presents its north (N) magnetic polarity facing toward the strings 18 and its south (S) magnetic polarity facing toward the body portion 16 of the stringed musical instrument 12. It should be appreciated that the magnets 32 can be arranged to present an opposite polarity.

The sensor assembly 10 includes a grounding board 34 at a lower portion of the bobbin 20. The grounding board 34 is a printed circuit board having at least one, preferably a plurality of apertures 35 spaced longitudinally to receive a lower end of the magnets 32. The grounding board 34 also includes an aperture 36 for a portion of comb pieces 38 and 40 to be described. The grounding board 34 has wires 37 for connection to a socket (not shown) on the stringed musical instrument 12 for connection to an amplifier and speaker system (not shown).

The sensor assembly 10 also includes at least one, preferably a plurality such as two, pair of comb pieces 38 and 40 having a generally inverted "1" shape. The comb pieces 38 and 40 each have a base wall 42 and a side wall 44 generally perpendicular to the base wall 42. The side wall 44 has a plurality of recesses 45 at exposed exterior edges thereof to define rows of tooth-like projections or teeth 46 for a function to be described. The recesses 45 are generally rectangular in shape and have a width greater than a width of the teeth 46.

The comb pieces 38 and 40 are made of a ferromagnetic material such as an iron based steel. The comb pieces 38 and 40 extend longitudinally and have a slot 50 extending laterally into the base wall 42 and side wall 44 to allow the comb pieces 38 and 40 to be bent to form a first or leg portion 52 and a second or arm portion 54 extending generally at an angle from the leg portion 52. The comb piece 38 is bent such that the leg portion 52 is disposed along the triangular portion 26 of the bobbin 20 and the arm portion 54 is disposed along the rectangular portion 28 of the bobbin 20. The comb piece 40 is disposed along the bottom of the flux diverter 24.

The sensor assembly 10 further includes at least one coil 60 disposed in a channel 62 between the comb pieces 38 and 40 and the bobbin 20 on each side of the bobbin 20. The coil 60 is a conductive wire such as copper wrapped or wound around the comb pieces 38 and 40 and flux diverter 24. The coils 60 have an overall triangular shape in which the point or small end of the coil 60 on one side is placed adjacent to the large end of the other coil 60. This arrangement provides a unique relationship of coil wire to each individual magnet 32 and increased string to string definition and sensitivity. It should be appreciated that each coil 60 contacts the comb pieces 38 and 40 and may extend longitudinally beyond the ends of the bobbin 20. It should also be appreciated that the coils 60 are wound in opposite directions.

The sensor assembly 10 also includes a top cover 70 for enclosing the top of the bobbin 20, coils 60 and comb pieces 38 and 40. The top cover 70 extends longitudinally and has an inverted general "U" shape cross-section. The cover 70 has a generally planar base wall 72 and side walls 74 extending generally perpendicular from the base wall 72 to form a longitudinal cavity 76. The bobbin 20 is disposed within the longitudinal cavity 76. The top cover 70 also includes a flange 78 extending longitudinally from the side walls 74. The flanges 78 have an aperture 79 extending therethrough and are to secured by suitable means such as fasteners (not shown) extending through the apertures 79 to secure the top cover 70 to the body portion 16. The top cover 70 is made of a plastic material. It should be appreciated that the tabs 31 are disposed in the corner of the top cover 70 to space the top cover 70 from the coils 60.

The sensor assembly 10 also includes a bottom cover 80 for enclosing the bottom of the bobbin 20, coils 60 and comb pieces 38 and 40. The bottom cover 80 extends longitudinally and has a general "U" shape cross-section. The cover 80 has a generally planar base wall 82 and side walls 84 extending generally perpendicular from the base wall 82 to form a longitudinal cavity 86. The bobbin 20 is disposed within the longitudinal cavity 86. The bottom cover 80 is made of a plastic material. It should be appreciated that the bobbin 20 is sandwiched between the base wall 82 of the bottom cover 80 and the base wall 72 of the top cover 70.

In operation of the sensor assembly 10, the magnets 32 are disposed in the bobbin 20 and mounted therein. The comb pieces 38 and 40 are disposed along the flux diverters 24 and the coils 60 are disposed in the channels 62 on each side of the bobbin 20. The comb pieces 38 are magnetically polarized to the N polarity and the comb pieces 40 are magnetically polarized to the S polarity. The magnetic flux radiates out the axial ends of the magnets 32 and through the recesses 45 and teeth 46 define magnetic flux bottles or geometric flux shaping forms in each recess 45.

Figure 8:
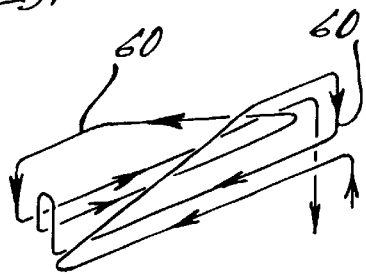
FIG. 8 is a diagram of current flow through the sensor assembly of FIG. 1.

When a string 18 moves the magnetic field, the flux pattern will change, thus inducing a voltage in each coil 60. Since the coils 60 are wound in opposite directions around their respective comb pieces 38 and 40 and connected together in series, the net signal from the sensor assembly 10 is the sum of the signals in the coils 60 and the hum in one of the coils 60 damps or cancels out that in the other as illustrated in FIG. 8.

Accordingly, the sensor assembly 10 has an arrangement of two coils 60 such that the hum in one of the coils damps or cancels out that in the other, while the signals in each coil add together to produce a stronger signal. It should be appreciated that the two coils 60 can be wound differently in an imbalanced manner to produce different tonal variances.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A sensor assembly for a stringed musical instrument having a plurality of movable strings comprising:

a bobbin extending longitudinally and having opposed sides;

at least one magnet disposed within said bobbin for producing a magnetic polarity;

a flux diverter extending outwardly from each of said opposed sides of said bobbin; and at least one coil extending longitudinally on each of said opposed sides of said bobbin for damping hum in said sensor assembly due to stray magnetic fields.

2. A sensor assembly as set forth in claim 1 wherein said at least one magnet is cylindrical in shape.

3. A sensor assembly as set forth in claim 1 including a cover extending longitudinally and having a U-shape.

4. A sensor assembly as set forth in claim 3 wherein said cover has a base wall and a pair of planar side walls substantially parallel to each other to form a longitudinal channel.

5. A sensor assembly as set forth in claim 1 wherein said at least one coil comprises copper wire wrapped around said bobbin.

6. A sensor assembly as set forth in claim 1 including a plurality of comb pieces disposed within said at least one coil and a spacer disposed between said comb pieces.

7. A sensor assembly as set forth in claim 6 wherein each of said comb pieces have a leg portion and an arm portion extending perpendicular to said leg portion.

8. A sensor assembly as set forth in claim 7 wherein said leg portion has a longitudinal length greater than a longitudinal length of said arm portion.

9. A sensor assembly as set forth in claim 7 wherein said arm portion and said leg portion has a plurality of longitudinally spaced teeth.

10. A sensor assembly for a stringed musical instrument having a plurality of movable strings comprising:

a bobbin extending longitudinally and having opposed sides;

a plurality of magnets disposed within said bobbin and spaced longitudinally for producing a magnetic polarity;

a flux diverter extending outwardly from each of said opposed sides of said bobbin, said flux diverter having a generally triangular portion; and a coil extending longitudinally on each of said opposed sides of said bobbin for damping hum in said sensor assembly due to stray magnetic fields.

11. A sensor assembly as set forth in claim 10 wherein said magnets are cylindrical in shape.

12. A sensor assembly as set forth in claim 10 including a cover extending longitudinally and having a U-shape.

13. A sensor assembly as set forth in claim 12 wherein said cover has a base wall and a pair of planar side walls substantially parallel to each other to form a longitudinal channel.

14. A sensor assembly as set forth in claim 10 wherein said coil comprises copper wire wrapped around said bobbin.

15. A sensor assembly as set forth in claim 10 including a plurality of comb pieces disposed within said coil and a spacer disposed between said comb pieces.

16. A sensor assembly as set forth in claim 15 wherein each of said comb pieces have a leg portion and an arm portion extending perpendicular to said leg portion.

17. A sensor assembly as set forth in claim 16 wherein said leg portion has a longitudinal length greater than a longitudinal length of said arm portion.

18. A sensor assembly as set forth in claim 16 wherein said arm portion and said leg portion has a plurality of longitudinally spaced teeth.

19. A sensor assembly for a stringed musical instrument having a plurality of movable strings comprising:

a bobbin extending longitudinally and having opposed sides;

at least one magnet disposed within said bobbin for producing a magnetic polarity;

a flux diverter extending outwardly form each of said opposed sides of said bobbin, said flux diverter having a generally triangular portion with a point at a lower end of one longitudinal end of said bobbin; and at least one coil extending longitudinally on each of said opposed sides of said bobbin for damping hum in said sensor assembly due to stray magnetic fields.

* * * * *

UNITED STATES PATENT AND TRADEMARK OFFICE

CERTIFICATE OF CORRECTION

PATENT NO. : 6,111,185

DATED : August 29, 2000

INVENTOR(S) : Jeffrey J. Lace

It is certified that error appears in the above-identified patent and that said Letters Patent are hereby corrected as shown below:

Column 6, Claim 19, line 7, "form" should read -- from --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*